United States Patent [19]

Davis et al.

[11] Patent Number: 5,042,651

[45] Date of Patent: Aug. 27, 1991

[54] STAND ALONE DISPOSABLE DISPLAY

[75] Inventors: A. Wayne Davis, Grapevine; Jerry C. Hardison, Dallas, both of Tex.

[73] Assignee: Lone Star Container Corporation, Irving, Tex.

[21] Appl. No.: 360,384

[22] Filed: Jun. 2, 1989

[51] Int. Cl.[5] ..... A47F 1/14; B65D 21/02

[52] U.S. Cl. ..... 206/45; 206/45.11; 211/73; 211/128; 493/90

[58] Field of Search ..... 206/44 R, 44.11, 44.12, 206/45, 45.11, 45.12; 211/72, 73, 128, 132, 133, 129, 130; 229/108, 108.1, 109, 110; 493/90, 162

[56] References Cited

U.S. PATENT DOCUMENTS

| | | | |
|---|---|---|---|
| 2,150,743 | 3/1939 | Mancuso | 229/108.1 |
| 2,290,144 | 7/1942 | Katz | 229/110 |
| 2,659,483 | 11/1953 | Paige et al. | 206/44 R |
| 2,940,710 | 6/1960 | Adams | 211/73 |
| 3,285,399 | 11/1966 | Snow | 206/44 R |
| 3,656,611 | 4/1972 | Mertz | 206/44 R |
| 4,570,805 | 2/1986 | Smith | 211/132 |
| 4,646,922 | 3/1987 | Smith | 211/132 |
| 4,723,664 | 2/1988 | Smith | 211/132 |
| 4,771,900 | 9/1988 | Leoncavallo et al. | 211/128 |

FOREIGN PATENT DOCUMENTS

| | | | |
|---|---|---|---|
| 2527177 | 11/1983 | France | 206/44 R |
| 0309713 | 3/1969 | Sweden | 206/44 R |
| 0364167 | 1/1932 | United Kingdom | 211/133 |

*Primary Examiner*—Jimmy G. Foster

*Attorney, Agent, or Firm*—Crutsinger & Booth

[57] ABSTRACT

Disclosed is a stand alone disposable display formed from sheet material having an octagonal shaped framed formed from sheet material with cut-outs in the sides thereon for supporting a plurality of removable trays. The cut-outs are formed with portions that fold into the interior of the octagonal shaped frame to add strength and rigidity to the frame. Surface means are provided on the frame for supporting a header on which advertising or printing can be placed. The trays are sized to fit to cooperate with a shipping container to provide loading of the trays without having to handle the products.

11 Claims, 7 Drawing Sheets

STAND ALONE DISPOSABLE DISPLAY

BACKGROUND OF THE INVENTION

The present invention relates to the display for sale of consumer products and, more particularly, to a new and improved disposable stand alone product display.

It has been found that sales of consumer products can, in many instances, be dependent upon the amount of display and stacking space available for the product. Competition among suppliers for retail shelf space is intense; for example, in grocery stores, the permanent rack or shelf space available to display snack foods and other products is limited. Shelf space for special promotions and new products is virtually unavailable. Innovative suppliers have created their own space for their products with stand alone displays such as aisle racks, bins and the like. In practice, these displays are placed in the stores with the management's consent and are installed, serviced and maintained stocked by route personnel employed by the product supplier. Although conventional permanent stand alone racks and bins have been used, they are not cost effective for many reasons. First, in many instances, the retail store provides space on a temporary basis to a supplier for use with a display. In other instances, the need to constantly present a new look to catch the consumer's eye causes the display to become obsolete. The manufacturing costs of these units prohibits their effective short-term use.

Second, these units are heavy and bulky to transport and time consuming to assemble and to disassemble. They take up valuable space on the route employee truck and consume valuable time in their assembly and disassembly. As a result, conventionally constructed displays of this type have experienced a limited use.

Attempts have been made to produce inexpensive, disposable displays to reduce manufacturing costs. One such display constructed from a plurality of rectangular trays of corrugated arranged in a parallel vertically spaced relationship. Each of the corners of these trays are fixed to a tubular column which rigidly supports the trays from the floor. In some instances, these racks can be five to six feet in height and have a corrugated quadrilateral base interconnecting the four columns at the floor. Printing in the form of advertising is typical on the exposed portions of the trays.

In other prior art designs, the use of angle shaped corrugated columns has been attempted. These prior art racks are somewhat less expensive to manufacture than conventional racks; however, they have been complicated in construction and time consuming to assemble and load.

SUMMARY OF THE INVENTION

The present invention provides a stand alone product display rack which is inexpensive to manufacture and simple to install. The rack is constructed with the frame formed from sheet material which folds flat for shipping to reduce the space requirements. The frame does not require complicated assembly by route personnel and quickly unfolds to its self-supporting shape. The frame provides surfaces for removably supporting a plurality of product display trays. The trays are likewise constructed from sheet material that folds to a compact shipping configuration. According to the invention, the trays are of a size and shape to fit a product shipping container so that the product can be dumped directly into the tray. In addition, the frame removably supports a header which can be used to add to or change the display's appearance.

BRIEF DESCRIPTION OF THE DRAWINGS

The present invention will be described in reference to the accompanying drawings in which.

DETAILED DESCRIPTION OF THE DRAWINGS

Figure 1:
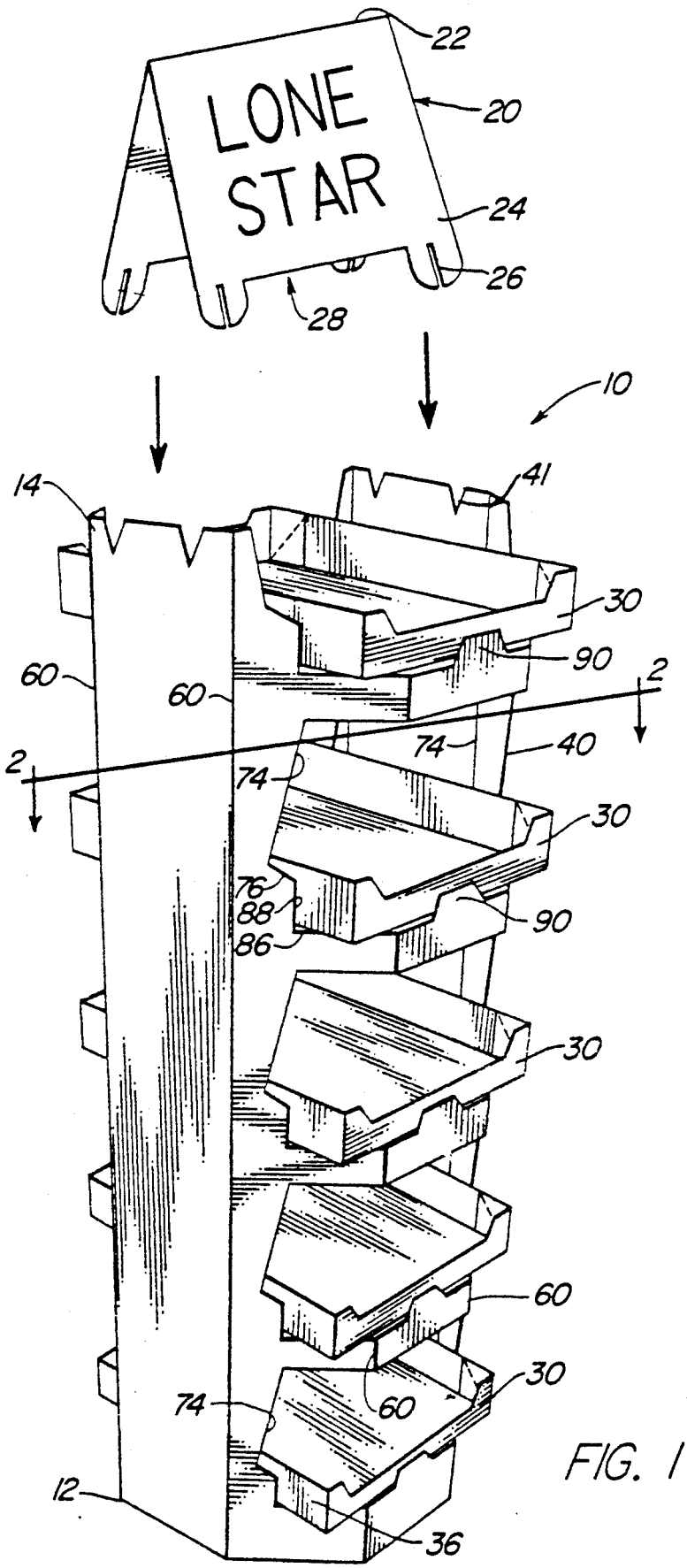
FIG. 1 is a perspective view of the improved stand alone disposable display of the present invention.

Referring now to the drawings wherein like reference characters designate like or corresponding parts throughout the several views there is illustrated in FIG. 1, the improved display of the present invention which for purposes of description is designated by reference numeral 10. In FIG. 1, the display is shown in its assembled form. As illustrated, the bottom edge of base 12 is designed to rest on the floor and support the assembly 10 in the erect position illustrated. As will be described in detail, the assembly can be quickly and easily assembled for use as a display of consumer products (not shown in FIG. 1 for purposes of clarity). In addition, as will be described herein, the display is designed to be shipped in a flat unassembled form. The design of the display allows it to be constructed from conventional corrugated materials and thus, after the display has been used, it can be discarded or disposed of.

The display assembly 10 consists of a header 20, a plurality of product display and sales trays 30 and a support frame 40. In the illustrated embodiment, five separate support trays are shown, however, it is to be understood of course that the assembly could be constructed with more or less trays as desired to fit the particular application.

The header 20 is constructed from a single sheet of material, folded at 22, to form an A-frame type structure. Four legs 24 are formed on the header with slots 26 for engaging corresponding slots 41 formed in the support frame 40. The slots 26 are of size and spacing to engage the corresponding slots 41 on the support frame to support the header on the upper end 14 of assembly 10. The slots 41 are optional, as the slots 26 could be designed to engage the upper ends of the frame 40. The header can be provided with suitable printed advertising or promotional messages and, thus, by removably attaching the header as illustrated, the header can be changed as desired to correspond to different products or promotions being displayed on assembly 10. As can be seen in FIG. 1, the header has a U-shaped recess 28 to allow full access to the uppermost tray 30. It is to be appreciated, of course, that if the header 20 is desired to be permanently affixed to the support frame 40, glue, staples, tape or other conventional forms of attaching sheet material together could be used.

Figure 3:
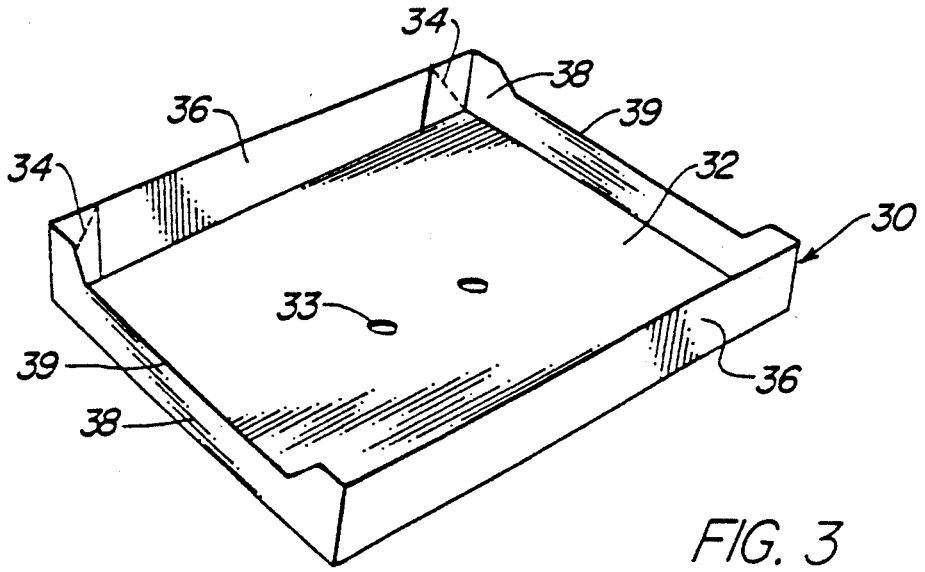
FIG. 3 is a perspective view of the tray.
Figure 4:
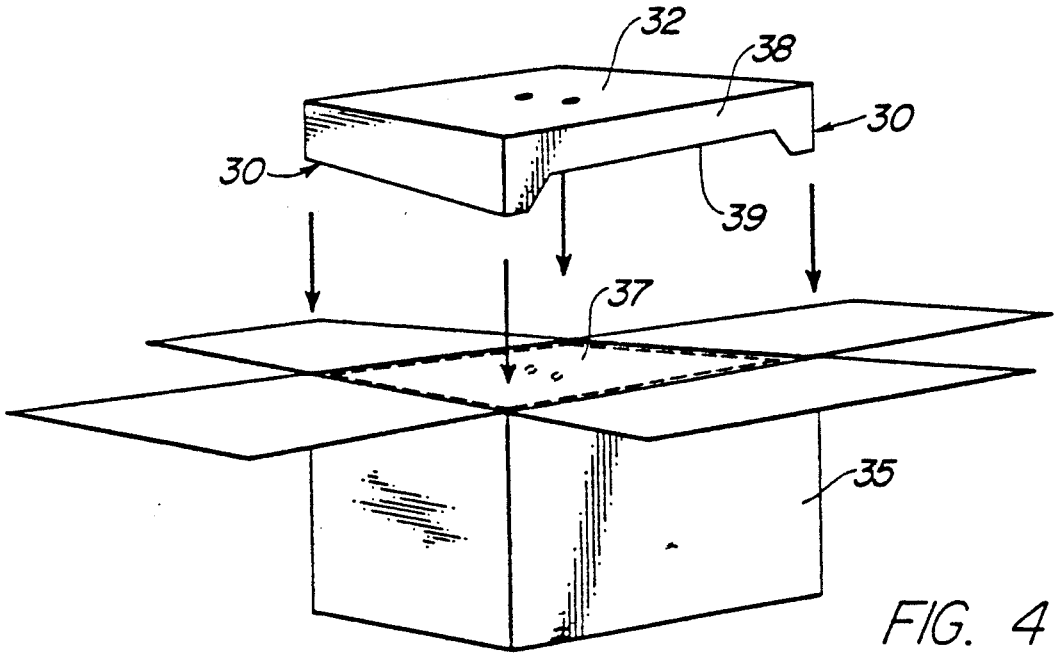
FIG. 4 is a expanded perspective view showing the tray in relationship to the shipping container showing the first step of loading the tray.

The support tray 30 is illustrated in FIG. 3. The tray consist of a generally quadrilateral shaped support surface 32 which is bordered on all sides by a lip. The tray 30 and its corresponding lip are conventionally designed to fold into a flat configuration by folding the lip along four scores identified by numeral 34. In the preferred embodiment, the lip varies in height around the support surface 32. As is illustrated, the quadrilateral support surface 32 is generally rectangular in shape. The lips 36 are adjacent the longer side and have a uniform height. The lips 38 are adjacent the shorter sides of the support surface 36. U-shaped slots 39 are removed from sides 38 as shown in FIGS. 3 and 4. These slots 39 provide additional viewing and access to the products held in the trays 30.

Figure 5:
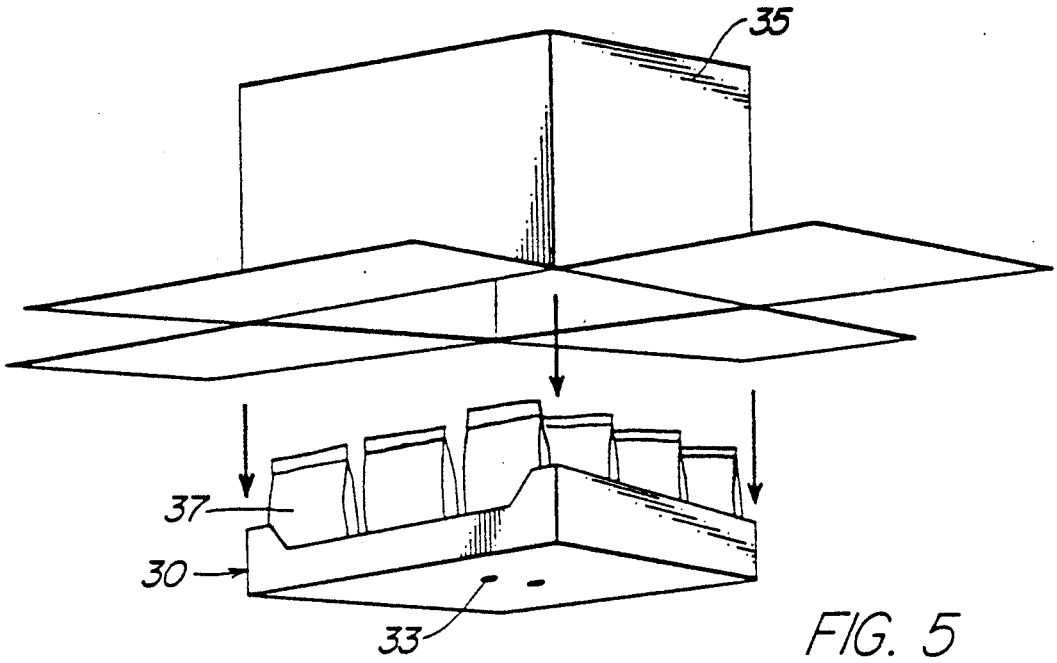
FIG. 5 is a view similar to FIG. 4 showing the product loaded in the tray.

According to a particular feature of the present invention, trays 30 are designed to be of a size to cooperate with the shipping containers for the goods to be displayed. This relationship is illustrated in FIGS. 4 and 5. The tray 30 is designed to be of a size to fit within the open end of the container 35. After opening the bottom of the container 35, as shown in FIG. 4, to expose the product 37 therein, the tray 30 can be inserted into the container. The tray 30 is designed to be of a size such that the lips 36 and 38 will slide into the container 35 adjacent to the sides in the space between the product 37 and the sides of the container 35. After the tray 30 is moved into the container 35, the container is turned over (right side up) as shown in FIG. 5 and lifted from the tray 30 leaving the product 37 supported on surface 32 of the tray 30. Finger holes 33 can be formed in the surface 32 to facilitate grasping the tray during separation of the container 35 from the tray 30. In this manner, the product is simply and quickly transferred from the shipping container 35 to the tray, this minimizing the stocking time. The tray, because it is removable from the assembly 10, can be removed, filled and replaced in assembly 10 in an efficient manner.

Figure 2:
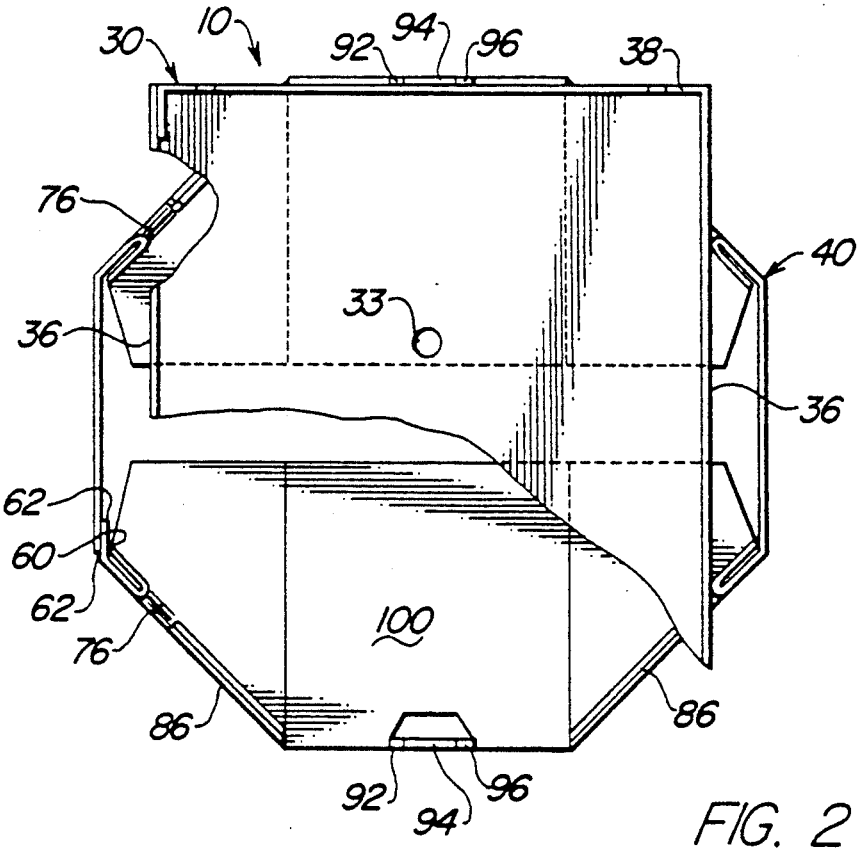
FIG. 2 is a sectional view taken along line 2—2 of FIG. 1 looking in the direction of the arrows.
Figure 6:
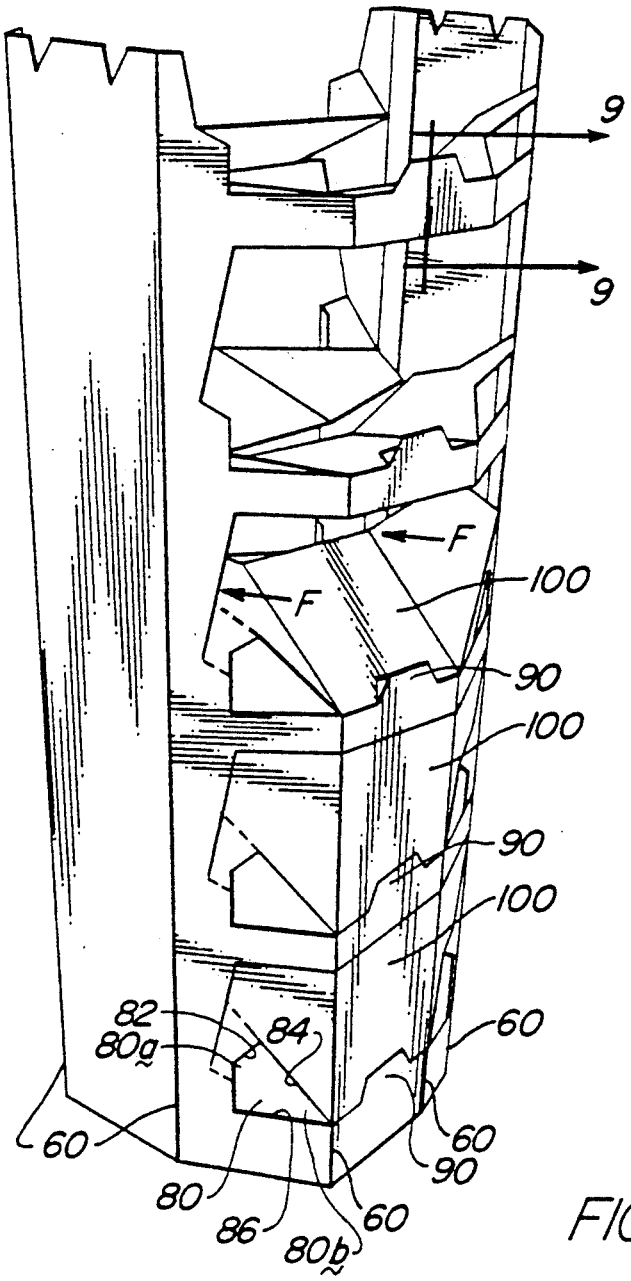
FIG. 6 is a perspective view of a support frame.
Figure 7:
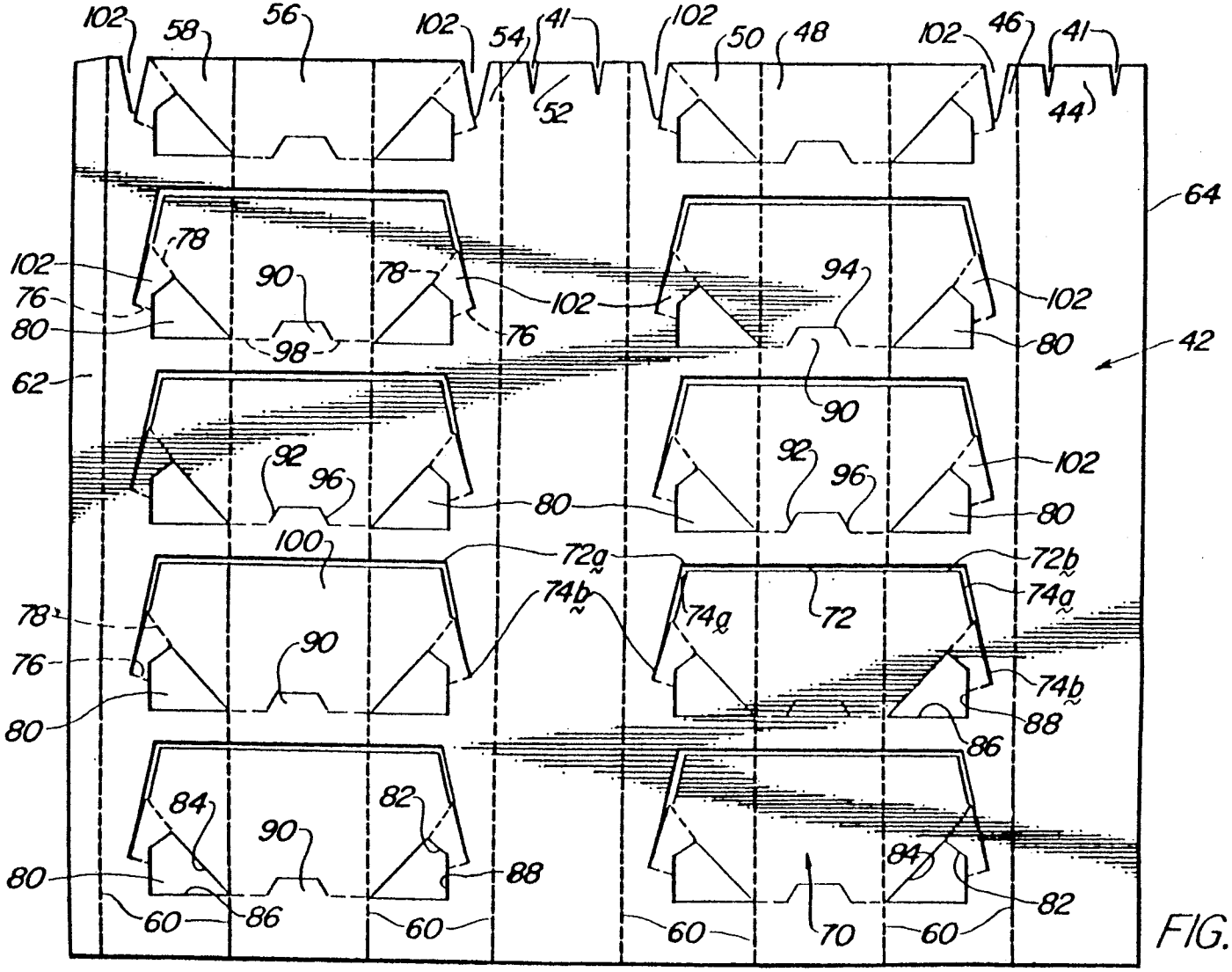
FIG. 7 illustrates a pattern for forming the support illustrated in FIG. 6.

The details of construction of the support frame 40 will be described primarily by reference to FIGS. 6, 7 and 8. In FIG. 7, the pattern for forming the support frame 40 from a sheet of corrugated material 42 is shown. When unfolded, the illustrated embodiment of support frame 40 will have an octagonal cross-section. It is to be understood that other multiple even numbered sided shapes could be used, preferably with six or more sides. This octagonal cross-section is formed by walls 44, 46, 48, 50, 52, 54 and 58. These walls are separated by eight conventional or perforated scores 60 formed in the sheet material 42. These scores 60 are represented by dotted lines in FIGS. 7 and 8. The scores 60 allow the sheet material to easily fold or hinge along the length of the score allowing the sheet material 42 to assume an octagonal shape when properly assembled. A sealing tab 62 is formed along an edge of the side 58. To assemble the sheet material 42 into the octagonal shape, sealing tab 62 is attached, as shown in FIG. 2, adjacent to the edge 62 by glue, staples, locking tabs or other suitable means. The edge 62 is positioned to coincide with the score 60 adjacent to tab 62. As previously described, four header receiving slots 41 can optionally be formed in the support frame 40 in side walls 44 and 52 as shown in FIG. 7.

Figure 8:
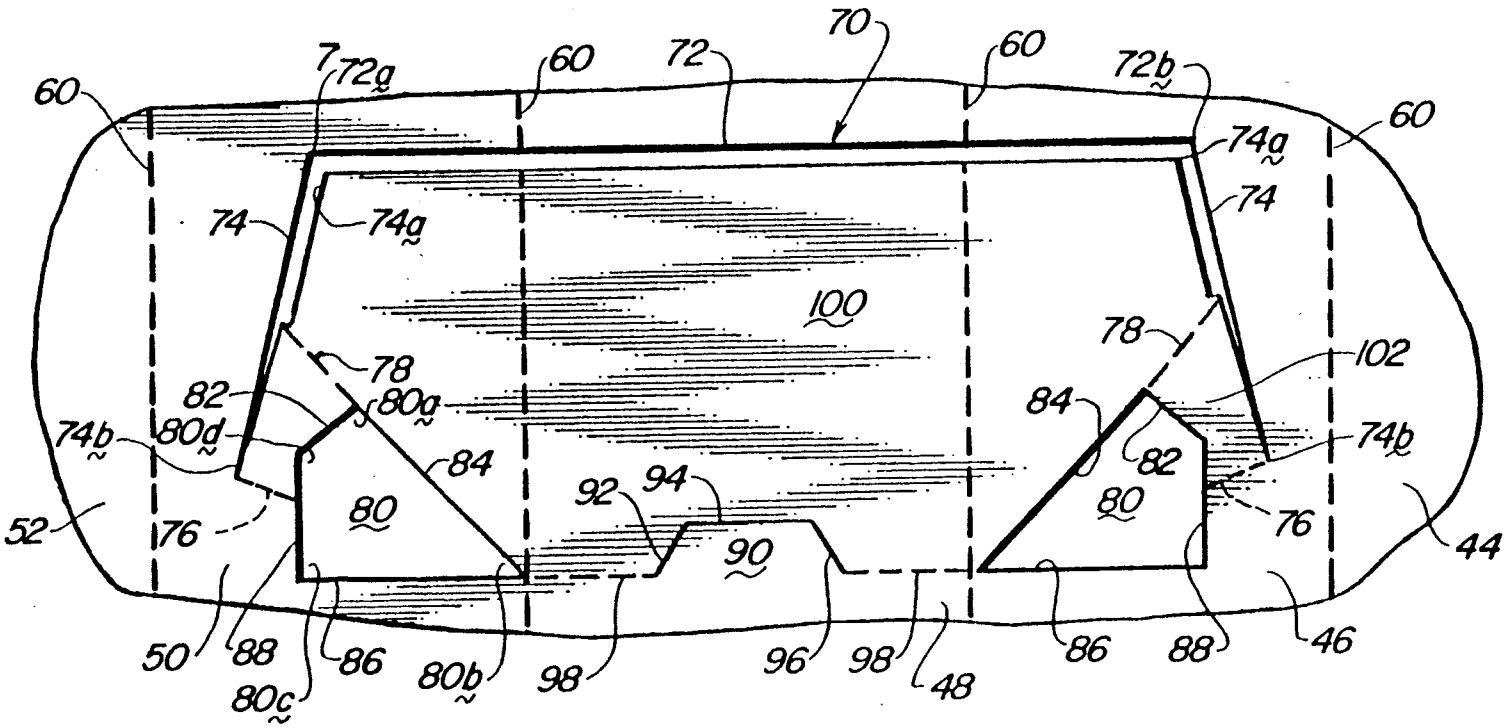
FIG. 8 is an enlarged view of a portion of the pattern illustrated in FIG. 7.

According to a particular feature of the present invention, a plurality of cut-outs or openings 70 for receiving the trays 30 are formed in the sheet material 42, one of which is illustrated in detail in FIG. 8. These cut-outs 70 are identically repeated throughout the sheet material except as the differences noted hereafter. As is illustrated, the cut-outs 70 are formed in cooperating pairs. It is anticipated that at least one pair of cut-outs would be present and that more or less than are illustrated in FIG. 8 could be present to accommodate more or less trays. For purposes of understanding FIG. 8, the lines drawn as solid lines are cut lines in which the sheet material is completely severed along the line. The lines drawn as dotted lines are scores in the material to readily allow folding of the material along these lines. The illustrated embodiment of the cut-out 70 is shown formed by a transversely extending slot 72 formed in the sheet material extending from wall 36, entirely across wall 48 and partially into wall 50 (as shown in FIG. 8). Terminal ends **72*a* and 72*b* of slot 72 join terminal ends 74*a* of a slot 74, one of which is formed in wall 46 and the other of which is formed in wall 50. Slots 74 extend in a downward and outward direction from the terminal ends of cut line 72 as is viewed in FIG. 8. Slots 74 each terminate at their lower end 74*b* with score lines 76. Slot 74 each intersect a score line 78**.

Figure 9:
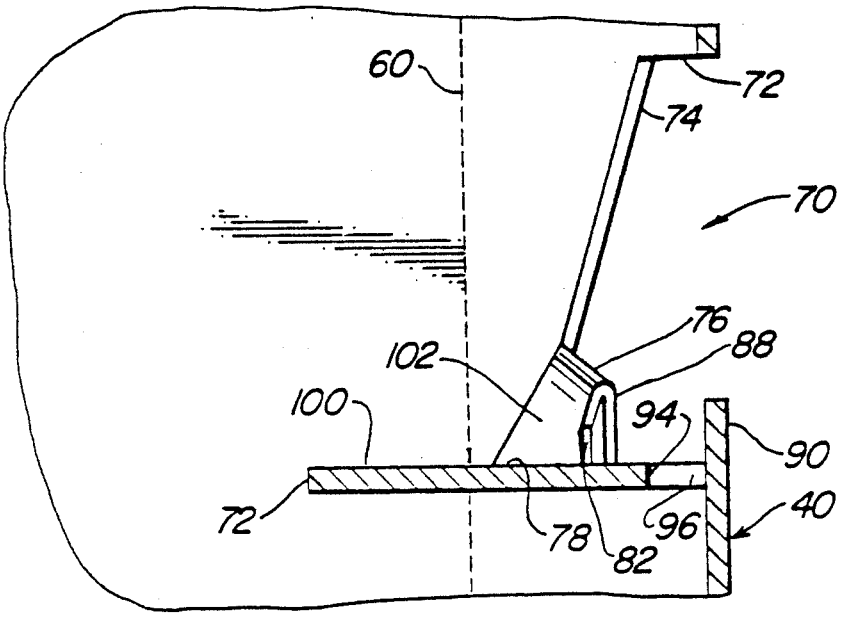
FIG. 9 is a sectional view taken on line 9—9 of FIG. 6 looking in the direction of arrows.

Score lines 76 and 78 each also extend from cut line 74 to intersect the boundary of a generally triangular shaped cut-out portion 80. As is illustrated, cut-out 80 is bounded by cut lines 82, 84, 86 and 88. It is to be noted that the cut lines 84 and 86 intersect at one of the score lines 60. A tab 90 is formed in wall 48 by cut lines 92, 94 and 96. Score lines 98 extend from the cut lines forming tab 90 to join cut line 86. The various cut lines described in FIG. 8 are such that when the sheet material 42 is folded into an octagonal shape, the surface 100 is folded inward, and a cut-out opening 70 will be formed in the interior of the support frame 40 (see FIG. 9). The above description of the cut-outs 70 is typical of the ten cut-outs formed in the interior of the sheet 42 shown in FIG. 7. The two uppermost cut-outs are identical in construction except that a pair of V-shaped cut-outs are formed in the upper edge of the sheet 42 to provide additional clearance. A shelf camming hanger 102 is defined by the one bounded by slot 74, score lines 76 and 78 and cut lines 82 and 88. The hanger 102 cooperates with the side of the tray 30 to retain the tray in the display position.

The frame 40 is first formed in the pattern shown in FIG. 7. Next, the tab 62 is positioned as shown in FIG. 2 and sealed to the inside of the sheet 42 along edge 64. The sheet 42 can then be folded flat along any two corresponding score lines 60 to form a flat shipping configuration. The various parts of the assembly can all be shipped flat to reduce space requirements during transportation to the store. To assemble the display, frame 40 is first folded into the octagonal shape shown in FIG. 6 and the ten cut-outs 70 are folded inward into the octagonal shaped frame by pressing in an inward direction at the edges surface 100 as shown in FIG. 6 and illustrated as arrow F. The trays 30 are then unfolded, loaded with material as previously described by reference to FIGS. 4 and 5 and placed in the frame 30 in the position as shown in FIG. 1 with the product therein.

Figure 10:
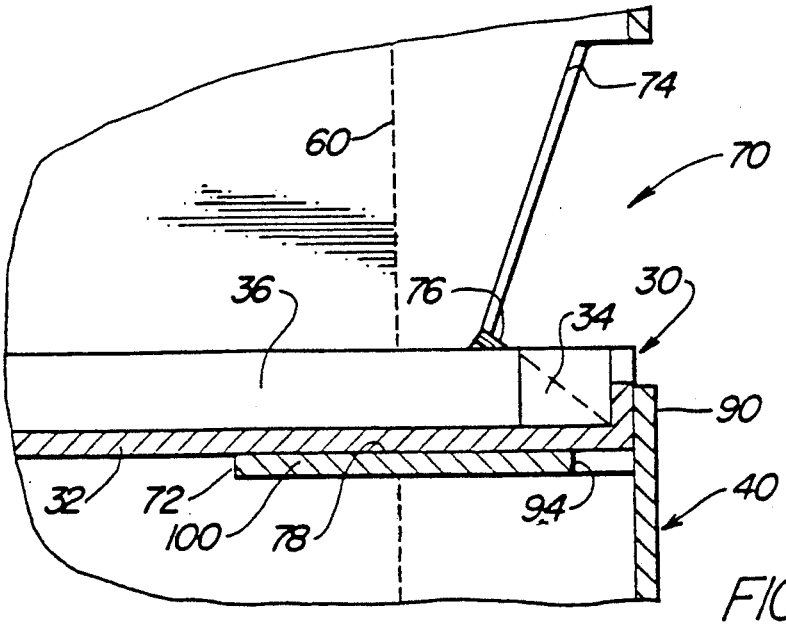
FIG. 10 is a view similar to FIG. 9 with a tray shown installed.

As shown in FIG. 10, the tray will span the distance between opposed cut-outs 70 and the tab 90 will hold the tray while it is supported upon surfaces 86 of the cut-out and surface 100. The score lines 76 and 78 act as hinges connecting the surface 100 to the frame. The edges of the surface 100 conform to the octagonal cross-section to provide rigidity to the corrugated frame. Finally, the header 20 can be attached to the frame in the manner described in regard to FIG. 1.

From the foregoing, it should be readily apparent that the method of forming display 10 comprises the steps of providing a display body 42; forming a slot 70 having terminal ends 72*a* and 72*b* in the display body; forming a pair of transversely extending slots 74 projecting downwardly from terminal ends 72*a* and 72*b* to form a generally C-shaped opening in the display body. Quadrilateral openings 80 formed in the display body are bounded on two sides by edges 84 and 86 which intersect at an acute angle 80*b* and are bounded on two sides by edges 82 and 86 intersecting at an obtuse angle 80*d*. A generally C-shaped cut 82, 84, 86 in the display body has extremities aligned with one of the edges of the quadrilateral opening which form the acute angle. Score lines 98 extend between extremities of the C-shaped cut and the acute angles.

Score lines 78 are aligned with edges 84 and intersect transversely extending slots 74 intermediate terminal ends of transversely extending slots 74. A score line extends from a terminal end 74*b* of each of the transversely extending slots 74 and intersects one of the edges of the quadrilateral opening.

Score lines 60 extend longitudinally of the display body 42, at least two of the score lines 60 lying intermediate terminal ends 72*a* and 72*b* of slot 72 and at least two of the score lines extending generally perpendicular to slot 72 and spaced outwardly from terminal ends 72*a* and 72*b* to form three sides on the display body. Slot 72 extends substantially perpendicular to the score lines, a central portion of the slot 72 lying in a plane of a first of the walls and terminal ends 72*a* and 72*b* of slot 72 being formed in spaced second and third walls.

It is to be appreciated, of course, that the foregoing description relates to a preferred embodiment of the present invention and that numerous modifications/alterations could be made in the disclosed embodiment without departing from the spirit and scope of the invention as disclosed in the appended claims.

What is claimed is:

1. A disposable self supporting display for use in displaying and dispensing product comprising in combination, a frame formed from sheet material joined together along one edge to form when in a display configuration a multi-sided structure having at least six side walls separated by spaced fold lines, at least two said fold lines being parallel extending and equally spaced apart whereby the frame can be folded into a flat transport configuration, said frame having means for supporting the frame on a horizontal surface in the display configuration, said frame having at least one pair of aligned cut-outs in said sheet material forming said frame, edge means around said cut-out defining a support plane, and at least one tray means for removable support by said frame, said tray being of a size and shape to extend into said cut-out and contact and be supported by said edge means in a vertically elevated position when said frame is in said display configuration.

2. The display of claim 1 wherein said frame additionally comprises shelf portions joined to the frame by fold lines to fold into the interior of said frame and form a horizontally extending shelf means for adding rigidity to said frame when in the display position.

3. The display of claim 1, wherein said frame is octagonal shaped.

4. The display of claim 1, wherein said frame has tab means formed adjacent said cut-outs for engaging and retaining said trays in the display position

5. The display of claim 1, additionally comprising a shipping container for containing and transporting a product, said shipping container being of a size and shape to telescope with said tray to allow the transfer of said product from said shipping container to said tray.

6. The display of claim 1 wherein each of said cut-outs is formed in a portion of at least three of the side walls of said frame.

7. The display of claim 1 additionally comprising a removable header 20 connected to said frame when said frame is in the display configuration.

8. A method of forming a display comprising the steps of:

providing a display body;

forming a slot having terminal ends in the display body; forming a pair of transversely extending slots projecting downwardly from said terminal ends, said slots being arranged to form a generally C-shaped shelf and an opening in said display body;

forming a pair of quadrilateral openings in the display body, each of said quadrilateral openings being bounded on two sides by edges which intersect at an acute angle and being bounded on two sides by edges intersecting at an obtuse angle;

forming a generally C-shaped cut in the display body, said C-shaped cut having extremities aligned with one of the edges of said quadrilateral openings which form the acute angle; forming score lines extending between extremities of said C-shaped cut and said acute angles; forming score lines aligned with said edges and intersecting said transversely extending slots intermediate terminal ends of said transversely extending slots; forming a score line extending from a terminal end of said each of said transversely extending slots, said score line intersecting one of said edges of said quadrilateral opening;

forming at least eight score lines extending longitudinally of said display body, at least two of said score lines lying intermediate terminal ends of said slot and at least two of said score lines extending generally perpendicular to slot and spaced outwardly from terminal ends and to form three sides on said display body, said slot extending substantially perpendicular to said score lines, a central portion of said slot lying in a plane of a first of said walls and terminal ends and of slot being formed in second and third walls of said display body; and applying force for deflecting the surface of shelf into a generally horizontal plane.

9. The method of claim 8, each of said acute angles comprising angles of approximately forty-five degrees.

10. The method of claim 8, each of said obtuse angles comprising angles of approximately 135 degrees.

11. The method of claim 8, said laterally extending slots intersecting said slot at an included angle of approximately 105 degrees.

* * * * *

UNITED STATES PATENT AND TRADEMARK OFFICE

CERTIFICATE OF CORRECTION

PATENT NO. : 5,042,651

DATED : August 27, 1991

INVENTOR(S) : Davis et al.

It is certified that error appears in the above-identified patent and that said Letters Patent is hereby corrected as shown below: On the Title page, In "Abstract", line 2, change "framed" to -- frame --.

In Column 6, line 10 — 11, change "a product" to -- product --.

In Column 6, line 13 change "said product" to -- product --.

In Column 6, line 18 change "header 20" to -- header --

Signed and Sealed this

Twenty-ninth Day of December, 1992

*Attest:*

DOUGLAS B. COMER

*Attesting Officer*

*Acting Commissioner of Patents and Trademarks*